US010974511B2

(12) United States Patent
Tanaka et al.

(10) Patent No.: US 10,974,511 B2
(45) Date of Patent: Apr. 13, 2021

(54) LIQUID DISCHARGE DEVICE, AND LIQUID DISCHARGE APPARATUS AND DYEING APPARATUS INCLUDING SAME

(71) Applicants: Shinya Tanaka, Kanagawa (JP); Hiroyuki Yamashita, Kanagawa (JP)

(72) Inventors: Shinya Tanaka, Kanagawa (JP); Hiroyuki Yamashita, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/714,843

(22) Filed: Dec. 16, 2019

(65) Prior Publication Data

US 2020/0207087 A1 Jul. 2, 2020

(30) Foreign Application Priority Data

Dec. 28, 2018 (JP) ..... JP2018-248156
Nov. 9, 2019 (JP) ..... JP2019-203605

(51) Int. Cl.
*B41J 2/165* (2006.01)
*D06B 11/00* (2006.01)
(Continued)

(52) U.S. Cl.
CPC ..... *B41J 2/145* (2013.01); *B41J 2/16523* (2013.01); *B41J 2/16526* (2013.01);
(Continued)

(58) Field of Classification Search
CPC ..... B41J 2/145; B41J 2/16523; B41J 3/4078; B41J 2002/16514; B41J 2/16526;
(Continued)

(56) References Cited

U.S. PATENT DOCUMENTS 3,863,310 A 2/1975 Ochsner
4,029,006 A 6/1977 Mercer
(Continued)

FOREIGN PATENT DOCUMENTS

CH 697623 B1 12/2008
JP 6-305129 11/1994
(Continued)

OTHER PUBLICATIONS

Extended European Search Report dated May 29, 2020, issued in corresponding European Patent Application No. 19215062.1, 11 pages.

*Primary Examiner* — Yaovi M Ameh
(74) *Attorney, Agent, or Firm* — Xsensus LLP

(57) ABSTRACT

A liquid discharge apparatus includes a head including a nozzle plate having a plurality of nozzles lined in a row and configured to discharge a liquid, a conveyor configured to convey the liquid application target, and a liquid receptacle configured to receive the liquid discharged from the head. The conveyor defines a conveyance passage of a liquid application target to which the head applies the liquid. The liquid receptacle has an opening through which the liquid discharged from the head passes. A longitudinal direction of the opening is along a movement direction of the liquid application target. A width of the opening is greater than a width of the liquid application target in a direction orthogonal to the movement direction.

10 Claims, 7 Drawing Sheets

(51) Int. Cl.

| | |
|---|---|
| ***B41J 2/145*** | (2006.01) |
| ***D05C 13/00*** | (2006.01) |
| ***D05C 11/24*** | (2006.01) |
| ***B41J 3/407*** | (2006.01) |
| ***D06P 5/30*** | (2006.01) |
| *B41J 11/00* | (2006.01) |

(52) U.S. Cl.
CPC ..... *B41J 3/4078* (2013.01); *D05C 11/24* (2013.01); *D05C 13/00* (2013.01); *D06B 11/0023* (2013.01); *D06P 5/30* (2013.01); *B41J 2/16508* (2013.01); *B41J 2/16538* (2013.01); *B41J 2/16547* (2013.01); *B41J 11/002* (2013.01); *B41J 11/0015* (2013.01); *B41J 2002/16514* (2013.01); *D05D 2305/22* (2013.01)

(58) Field of Classification Search
CPC .. B41J 11/002; B41J 11/0015; B41J 2/16547; B41J 2/16508; B41J 2/16538; D06P 5/30; D06B 11/0023; D05C 11/24; D05C 13/00; D05D 2305/22
See application file for complete search history.

(56) References Cited

U.S. PATENT DOCUMENTS

| | | | | |
|---|---|---|---|---|
| 5,444,466 | A | 8/1995 | Smyczek et al. | |
| 5,983,678 | A * | 11/1999 | Enderlin ..... | D06B 19/0005 68/10 |
| 6,134,924 | A | 10/2000 | Enderlin et al. | |
| 6,189,989 | B1 * | 2/2001 | Hirabayashi ..... | B41J 3/407 347/106 |
| 2009/0295854 | A1 * | 12/2009 | Kawakami ..... | B41J 2/185 347/10 |
| 2014/0053347 | A1 | 2/2014 | Morton et al. | |

FOREIGN PATENT DOCUMENTS

| | | | |
|---|---|---|---|
| JP | H06-304359 | A | 11/1994 |
| JP | 2005-103849 | | 4/2005 |
| JP | 2006-159461 | | 6/2006 |
| JP | 2007-152885 | | 6/2007 |
| WO | WO2013/039447 | A1 | 3/2013 |
| WO | WO2016/204686 | A1 | 12/2016 |
| WO | WO2016/204687 | A1 | 12/2016 |
| WO | WO2017/155451 | A1 | 9/2017 |
| WO | WO2017/200473 | A1 | 11/2017 |
| WO | WO2018/044222 | A1 | 3/2018 |

* cited by examiner

LIQUID DISCHARGE DEVICE, AND LIQUID DISCHARGE APPARATUS AND DYEING APPARATUS INCLUDING SAME

CROSS-REFERENCE TO RELATED APPLICATIONS

This patent application is based on and claims priority pursuant to 35 U.S.C. § 119(a) to Japanese Patent Application Nos. 2018-248156, filed on Dec. 28, 2018, and 2019-203605, filed on Nov. 9, 2019, in the Japan Patent Office, the entire disclosure of each of which is hereby incorporated by reference herein.

BACKGROUND

Technical Field

The present disclosure relates to a liquid discharge device, and a liquid discharge apparatus and a dyeing apparatus including the liquid discharge device.

Description of the Related Art

Apparatuses including a liquid discharge head discharge liquid that does not contribute to liquid application to a target, for maintenance and recovery of the liquid discharge head. The liquid not contributing to liquid application is discharged toward, for example, a liquid receptacle. Such an operation is called dummy discharge (also called flushing or purging).

SUMMARY

An aspect of this disclosure provides a liquid discharge apparatus that includes a head including a nozzle plate having a plurality of nozzles lined in a row and configured to discharge a liquid, a conveyor configured to convey the liquid application target, and a liquid receptacle configured to receive the liquid discharged from the head. The conveyor defines a conveyance passage of a liquid application target to which the head applies the liquid. The liquid receptacle has an opening through which the liquid discharged from the head passes. A longitudinal direction of the opening is along a movement direction of the liquid application target. The opening has a width greater than a width of the liquid application target in a direction orthogonal to the movement direction.

Another aspect of this disclosure provides a liquid discharge apparatus that includes the above-described head, the above-described conveyor, and a liquid receptacle configured to receive the liquid discharged from the head. The liquid receptacle has an opening through which the liquid discharged from the head passes. A width of the opening in a direction orthogonal to a nozzle row direction is greater than a width of the liquid application target in a direction orthogonal to a movement direction of the liquid application target.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
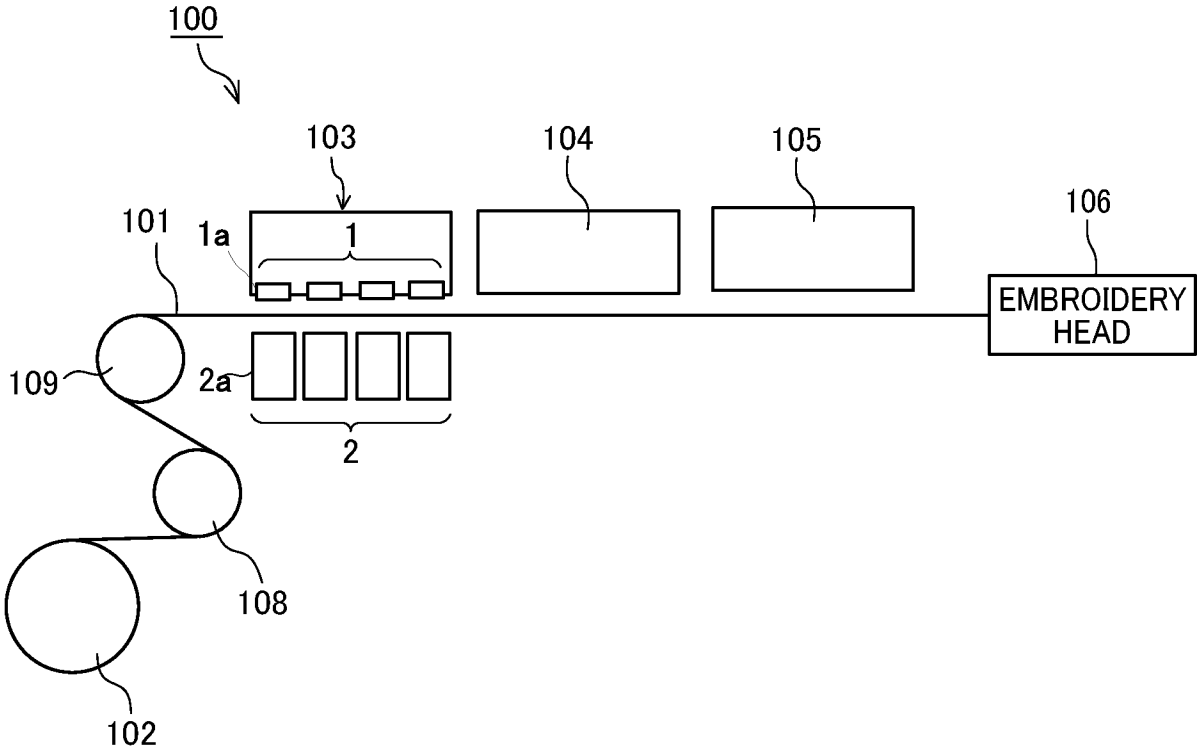
FIG. 1 is a schematic side view of a liquid discharge apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 2:
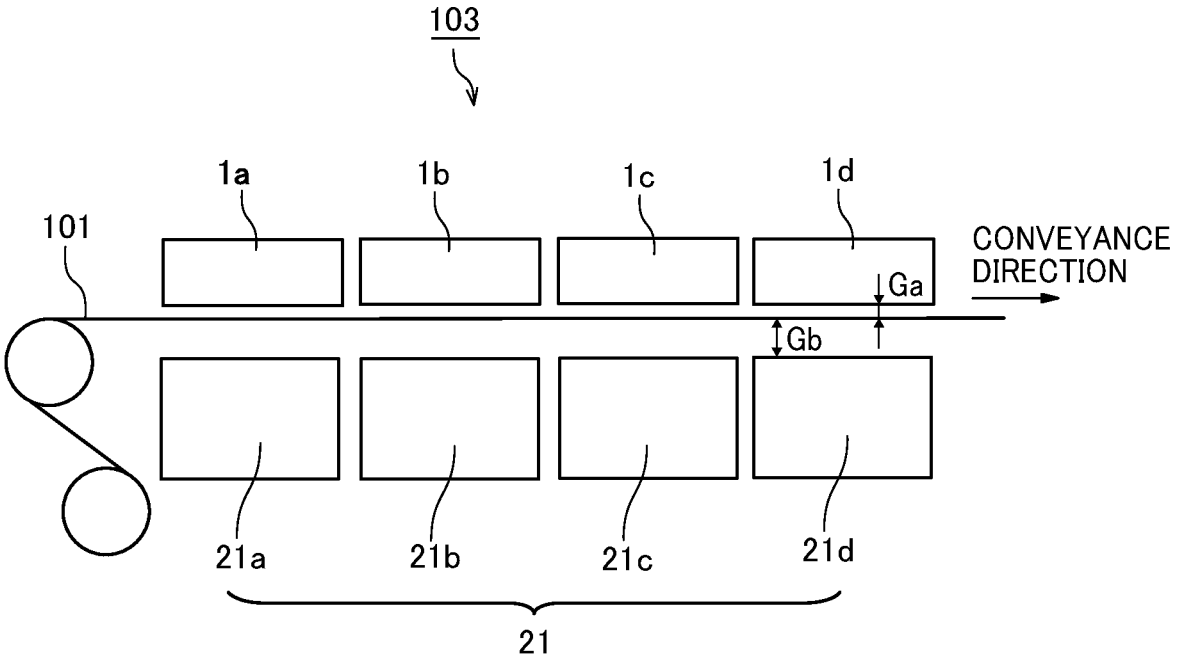
FIG. 2 is a schematic view of a liquid application unit (a liquid application device) of the liquid discharge apparatus illustrated in FIG. 1.
Figure 3:
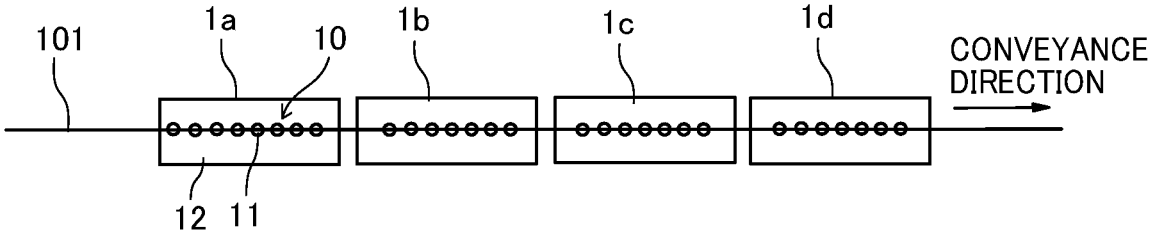
FIG. 3 is a plan view of a row of heads of the liquid application unit illustrated in FIG. 2, as viewed from below.

Referring now to the drawings, wherein like reference numerals designate identical or corresponding parts throughout the several views thereof, and particularly to FIGS. 1 to 3, a liquid discharge apparatus according to an embodiment of this disclosure is described. As used herein, the singular forms "a", "an", and "the" are intended to include the plural forms as well, unless the context clearly indicates otherwise.

FIG. 1 is a schematic view of the liquid discharge apparatus. FIG. 2 is a view of a liquid application unit of the liquid discharge apparatus. FIG. 3 is a view of a row of heads of the liquid application unit as viewed from below.

A liquid discharge apparatus 100 in FIG. 1 is an in-line embroidery machine. The liquid discharge apparatus 100 includes a supply reel 102 on which a thread 101 (a liquid application target) is wound, a liquid application unit 103 (a liquid application device), a fixing unit 104, a post-treatment unit 105, and an embroidery head 106.

The thread 101 drawn from the supply reel 102 is guided by rollers 108 and 109 as conveyors and continuously stretched to the embroidery head 106.

The liquid application unit 103 (the liquid discharge device) includes a plurality of heads 1 (1*a* to 1*d*) and a plurality of individual maintenance units 2 (2*a* to 2*d*) serving as maintenance devices. The liquid application unit 103 discharges a liquid of a required color onto the thread 101 which is drawn out from the supply reel 102. The individual maintenance units 2 perform maintenance of the heads 1, respectively. The heads 1*a* to 1*d* discharge, for example, cyan (C), magenta (M), yellow (Y), and black (K) color liquids.

As illustrated in FIG. 3, each of the heads 1 (1*a* to 1*d*) includes a nozzle plate 12 in which a plurality of nozzles 11 to discharge a liquid is formed. Specifically, on a face (hereinafter "nozzle face") of the nozzle plate 12, the plurality of nozzles 11 is lined in a row (a nozzle row 10). Each head 1 is disposed such that the direction (a nozzle row direction in which the nozzles 11 are lined) matches the direction of conveyance (movement direction) of the thread 101.

The individual maintenance units 2 respectively include liquid receptacles 21 (21*a* to 21*d*, illustrated in FIG. 2) disposed opposite the heads 1 with the thread 101 (the liquid application target) interposed therebetween.

The fixing unit 104 performs a fixing process (drying process) of the thread 101 to which the liquid is applied from the liquid application unit 103. The fixing unit 104 includes, for example, a heater such as an infrared irradiation device and a hot air sprayer, and heats the thread 101 to dry.

The post-treatment unit 105 includes, for example, a cleaning device that cleans the thread 101, a tension adjustment device that adjusts the tension of the thread 101, a feed amount detector that detects the amount of movement of the thread 101, and a lubricant application device that lubricates the surface of the thread 101.

The embroidery head 106 embroiders a pattern, for example, on a cloth with the thread 101.

Although the liquid discharge apparatus in the present embodiment is an embroidery machine, the present disclosure is not limited thereto. Aspects of the present disclosure are applicable to devices, such as weaving machines and sewing machines, that use linear objects such as threads. Further, aspects of the present disclosure can be applied not only to apparatuses having a post-process, such as an embroidery machine, but also to dyeing apparatuses and the like that dye and wind threads, etc. as described later.

Further, "thread" includes glass fiber thread, wool thread, cotton thread, synthetic thread, metal thread, wool, cotton, polymer, mixed metal thread, yam, filament, and linear objects (continuous base materials) to which liquid is applicable. Thus, the "thread" also includes braids and flat cords (flat braids).

Figure 4:
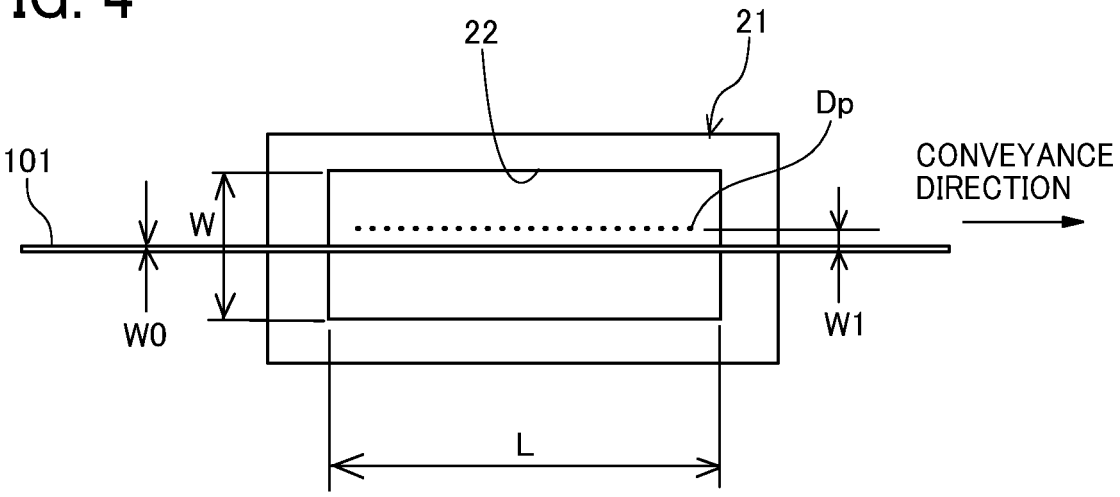
FIG. 4 is a plan view illustrating a liquid receptacle according to a first embodiment.
Figure 5:
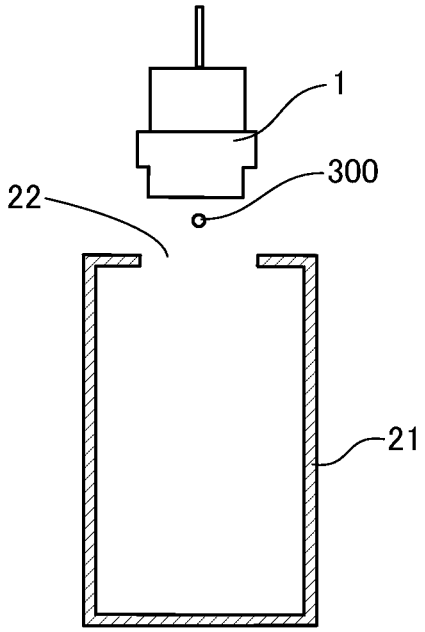
FIG. 5 is a cross-sectional view illustrating the liquid receptacle illustrated in FIG. 4, along a short-side direction thereof.

Next, a first embodiment of the present disclosure is described with reference to FIGS. 4 and 5. FIG. 4 is a plan view illustrating a liquid receptacle according to the present embodiment. FIG. 5 is a cross-sectional view illustrating the liquid receptacle along a short-side direction thereof.

The liquid receptacle 21 is a box-shaped container having an opening 22 through which a liquid (droplet) 300 discharged from the head 1 passes.

Figure 11A:
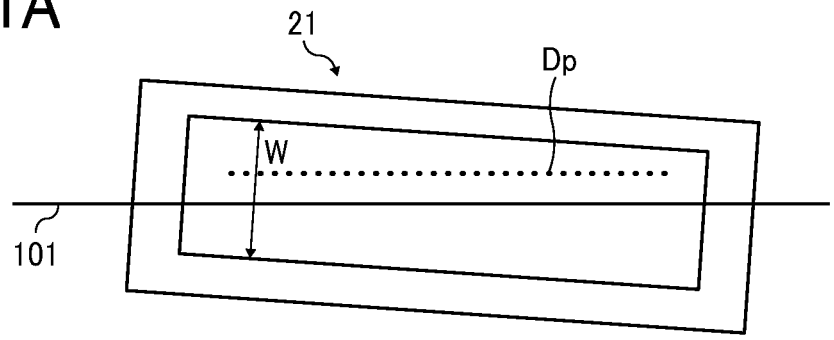
FIGS. 11A to 11C are plan views illustrating liquid receptacles according to variations of the structure illustrated in FIG. 4.

As illustrated in FIG. 4, the longitudinal direction of the opening 22 of the liquid receptacle 21 is along the movement direction (conveyance direction) of the thread 101 to which the liquid discharged from the head 1 is applied. The "direction along the movement direction" is not limited to directions parallel to the movement direction but includes, for example, the direction illustrated in FIG. 11A.

In the liquid receptacle 21, a width W (a short-side length) of the opening 22 is greater than a width W0 of the thread 101 (liquid application target) in the direction orthogonal to the movement direction, that is, the conveyance direction thereof (W>W0).

In the liquid receptacle 21, a length L (a long-side length) of the opening 22 is longer than the length of the nozzle row 10 of the head 1.

In the direction orthogonal to the conveyance direction of the thread 101 (orthogonal to the nozzle row direction), the head 1 is movable between a discharge position opposite the thread 101 and a dummy discharge position not opposite the thread 101 (for example, a dummy discharge position Dp indicated by a broken line in FIG. 4).

That is, both the head 1 at the discharge position and the head 1 at the dummy discharge position Dp oppose the opening 22 of the liquid receptacle 21. The head 1 constantly oppose the opening 22 during the movement from the discharge position to the dummy discharge position and the movement from the dummy discharge position to the discharge position.

With this configuration, to apply the liquid 300 to the thread 101, the head 1 discharges the liquid 300 at the discharge position there the nozzle row 10 thereof is opposite the thread 101 illustrated in FIG. 4. At this time, the liquid 300 that does not adhere to the thread 101 passes through the opening 22 of the liquid receptacle 21 positioned below and is collected in the liquid receptacle 21.

The dummy discharge from the head 1 is performed as follows. At the dummy discharge position Dp indicated by the broken line in FIG. 4, the head 1 discharges the liquid 300 that does not adhere to the thread 101. In this time, the liquid 300 discharged in the dummy discharge also passes through the opening 22 of the liquid receptacle 21 positioned below and is collected in the liquid receptacle 21.

As described above, the head 1 is kept opposed the opening 22 of the liquid receptacle 21 while moving from the discharge position to the dummy discharge position, to perform the dummy discharge. Accordingly, the dummy discharge can be performed at a position near the position where the liquid is applied to the thread 101. Accordingly, the distance by which the head 1 moves for the dummy discharge is short, and the dummy discharge operation can be performed efficiently, reducing the downtime.

The liquid receptacle 21 is disposed at a distance from the thread conveyance passage so that the thread 101 (the liquid application target) is contactless with the liquid receptacle 21. The thread conveyance passage is an example of a target conveyance passage and defined by the rollers 108 and 109, thread guides, and the like (serving as a conveyor to convey the target).

Such an arrangement is advantageous when the liquid is applied to a target that is liquid-permeable, like the thread 101, such that the time for the liquid to permeate from the landing side of the target to the opposite side is short. Since the target is contactless with the liquid receptacle 21, color bleeding can be inhibited.

Referring to FIG. 2, in the height direction, the liquid application target is disposed between the head 1 and the liquid receptacle 21 (in particular, the opening 22 thereof). A distance Gb from the liquid application target (the thread 101) to the liquid receptacle 21 is longer than a distance Ga between the head 1 and the liquid application target (the thread 101).

Such an arrangement can increase the accuracy of liquid landing position on the thread 101. Additionally, securing the distance Gb from the liquid receptacle 21 to the thread 101 can reduce unintended dyeing of the thread 101 due to dirt accumulated in the liquid receptacle 21.

Figure 11B:
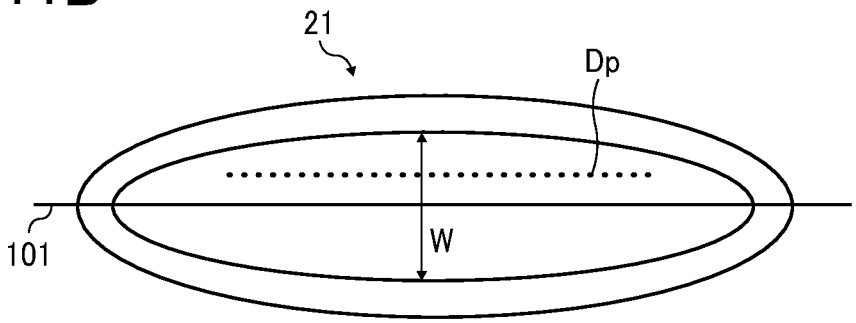

In the example described above, the shape of the opening of the liquid receptacle in plane (a shape in a plan view) is a rectangular shape having a short side and a long side, but the shape of the opening is not limited thereto. For example, the opening of the liquid receptacle can be elliptical in a plan view as illustrated in FIG. 11B.

That is, the above-described the width W (the short-side length) of the opening 22 is the length of the opening 22 in the direction orthogonal to the nozzle row direction of the head 1. Therefore, the width W of the opening 22 in the direction orthogonal to the nozzle row direction of the head 1 is set greater than the width W0 of the thread 101 (the liquid application target) in the direction orthogonal to the direction of movement of the thread 101 (W>W0). Such setting can provide the effects equivalent to those by the above-described embodiment.

Further, in the configuration in which the head 1 is movable between the discharge position (where the thread 101 is located) and the dummy discharge position Dp in the direction orthogonal to the nozzle row direction as in the above embodiment, as illustrated in FIG. 4, the width W of the opening 22 in the direction orthogonal to the nozzle row direction of the head 1 is set greater than a distance W1 between the discharge position and the dummy discharge position Dp (W>W1). Such setting can provide the effects equivalent to those by the above-described embodiment.

Figure 11C:
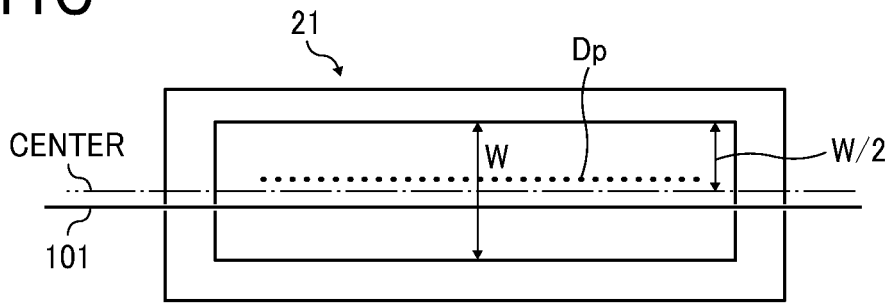

Further, as illustrated in FIG. 11C, in the short-side direction of the opening, the discharge position (the position of the thread 101) can be shifted to one side from the center, and the dummy discharge position Dp can be shifted to the other side (opposite to the discharge position) from the center. Such an arrangement enables more effective use of the area of the opening 22 and accordingly enables further reduction of the width of the opening 22 in the short-side direction.

In addition, these configurations can be combined with features of subsequent embodiments and a dyeing apparatus described later.

Figure 6:
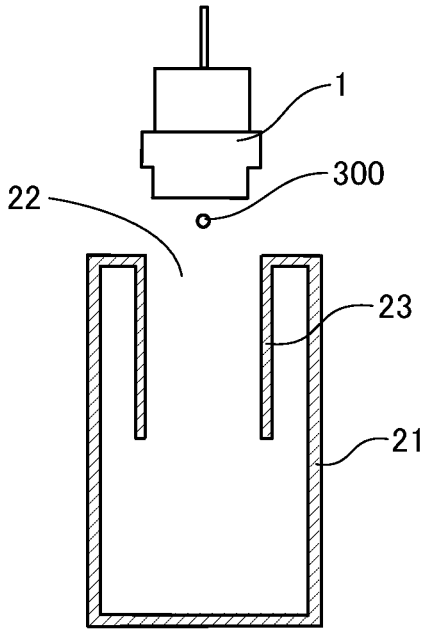
FIG. 6 is a cross-sectional view illustrating a liquid receptacle according to a second embodiment, along a short-side direction thereof.

Next, a second embodiment of the present disclosure is described with reference to FIG. 6. FIG. 6 is a cross-sectional view of a liquid receptacle along the short-side direction thereof according to the second embodiment.

The liquid receptacle 21 includes a flange 23 that extends down inward from the mouth defining the opening 22.

Mist arises from the liquid 30 entering the liquid receptacle 21, and the flange 23 can reduce the amount of the mist scattering outside from the opening 22.

Figure 7:
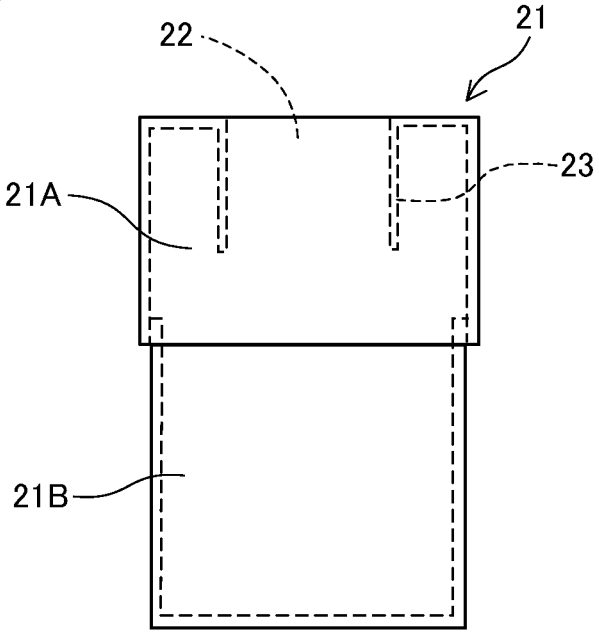
FIG. 7 is a cross-sectional view illustrating a liquid receptacle according to a third embodiment, along a short-side direction thereof.

Next, a third embodiment of the present disclosure is described with reference to FIG. 7. FIG. 7 is a cross-sectional view of a liquid receptacle along the short-side direction thereof according to the third embodiment.

The liquid receptacle 21 is constructed of two parts coupled together: an upper container 21A having an opening 22 and a flange 23; and a lower container 21B fitted to the upper container 21A.

Accordingly, the liquid receptacle 21 can be easily manufactured by injection molding.

Figure 8:
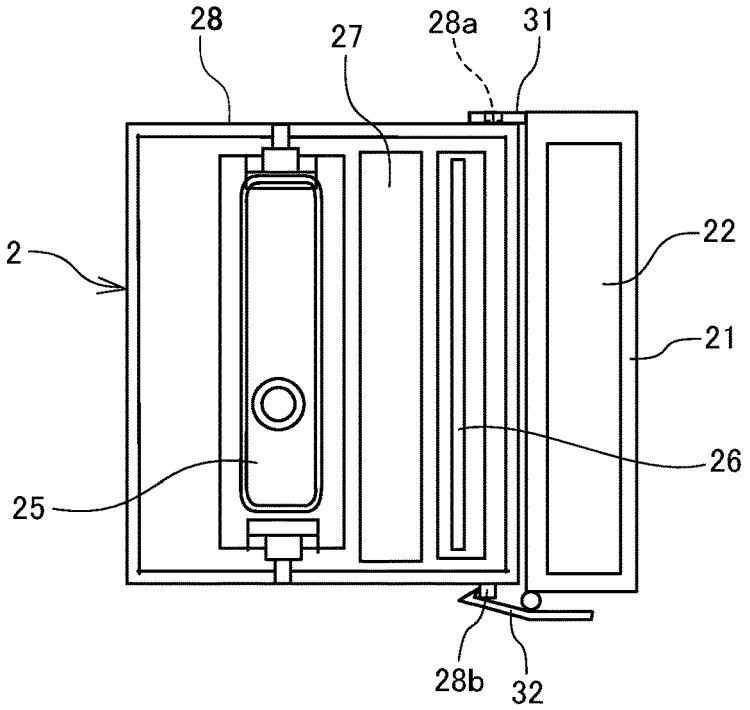
FIG. 8 is a schematic plan view of a maintenance unit according to a fourth embodiment.

Next, a fourth embodiment of the present disclosure is described with reference to FIG. 8. FIG. 8 is a schematic plan view of a maintenance unit according to the fourth embodiment.

The maintenance unit 2 illustrated in FIG. 8 includes a cap 25, a wiper 26, and a liquid receptacle 27 disposed in a housing 28. The cap 25 covers the nozzle face of the head 1. The wiper 26 wipes the nozzle face. The liquid receptacle 27 receives the liquid discharged in dummy discharge.

The liquid receptacle 21 is removably attached to the outer face of the housing 28 of the maintenance unit 2. For example, the liquid receptacle 21 includes engagement portions 31 and 32 to fit with bosses 28*a* and 28*b* (projections) of the housing 28, respectively, so that the liquid receptacle 21 can be attached to and detached from the housing 28.

Since the liquid receptacle 21 is removably attached to the maintenance unit 2, only the liquid receptacle 21 can be easily replaced when the liquid receptacle 21 is full.

Further, the maintenance unit 2 includes the liquid receptacle 27 so that the liquid discharged in dummy discharge can be collected in the liquid receptacle 21 or 27. This structure enables separate use of the liquid receptacles 21 and 27 in accordance with contents of dummy discharge operation. For example, when the number of droplets discharged by dummy discharge is large and the amount of mist increases, the dummy discharge is performed to the liquid receptacle 27 that is far from the thread 101. Thus, adhesion of mist to the thread 101 can be inhibited.

Figure 9:
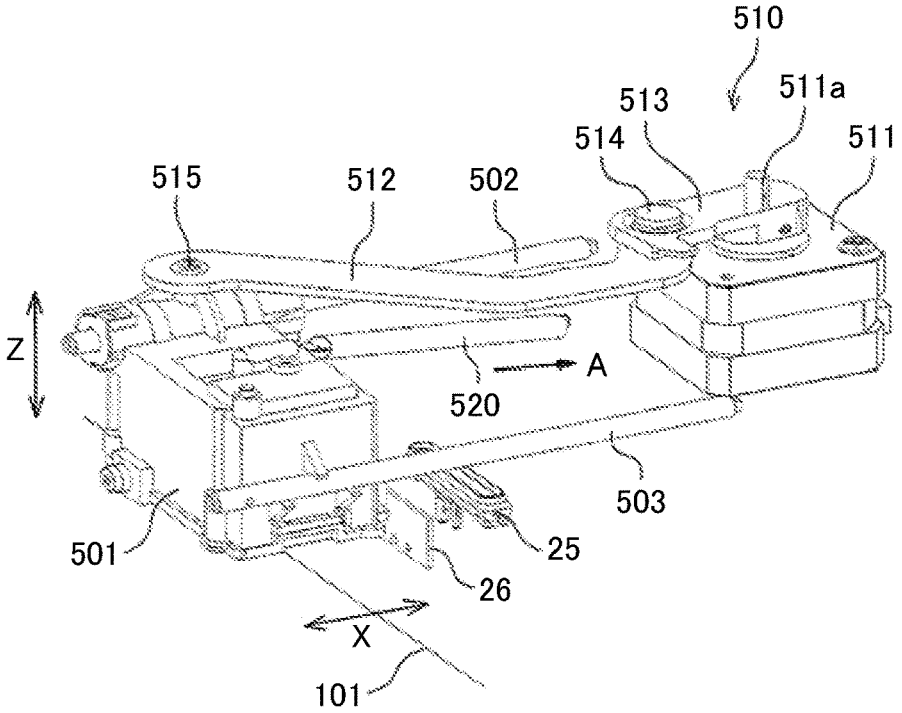
FIG. 9 is a perspective view of a structure of the liquid application unit relating to movement of one head, according to the fourth embodiment.

Next, a description is given of an example of a structure relating to the movement of the head according to the fourth embodiment, with reference to FIG. 9. FIG. 9 is a perspective view of a structure of the liquid application unit relating to movement of one head, according to the first embodiment.

The head 1 is mounted on a carriage 501 that can reciprocate in the direction indicated by arrow X. and the head 1 is moved between a home position where the head 1 is capped with the cap 25 of the individual maintenance unit 2 and a discharge position (dyeing position) where the head 1 discharges the liquid onto the thread 101.

In the present embodiment, the carriage 501 is held by a main guide rod 502 and a sub-guide member 503 and reciprocally movable.

The carriage 501 is provided with a driver 510 that reciprocates the carriage 501. The driver 510 includes a motor 511 and a crank 512 that is a drive force transmission member and moved by the motor 511. The carriage 501, the driver 510, and relating components serve as a head conveyor to move the head 1.

A rear end of the crank 512 is rotatably attached, with a shaft 514, to an arm 513 coupled to a motor shaft 511*a*. A front end of the crank 512 is rotatably coupled to the carriage 501 by a support shaft 515.

A tension coil spring 520, which is an elastic member, is disposed between the carriage 501 and a fixed portion. The tension coil spring 520 pulls the carriage 501 in the direction indicated by arrow A. Arrow Z indicates the direction of height.

With this structure, as the motor 511 of the driver 510 is driven, the carriage 501 reciprocates along the main guide rod 502 and the sub-guide member 503 via the crank 512.

In order to maintain and recover the head 1, the carriage 501 is repeatedly moved between the home position opposite the cap 25 that caps the head 1 and the discharge position where the liquid is applied to the thread 101 (liquid application target) for dyeing (printing) and stopped at the home position and the discharge position.

The above-described structure regarding the movement of the head 1 according to the present embodiment can be used as the structure mentioned in the first embodiment, to move the head 1 between the discharge position (position of the thread 101) and the dummy discharge position Dp.

Figure 10:
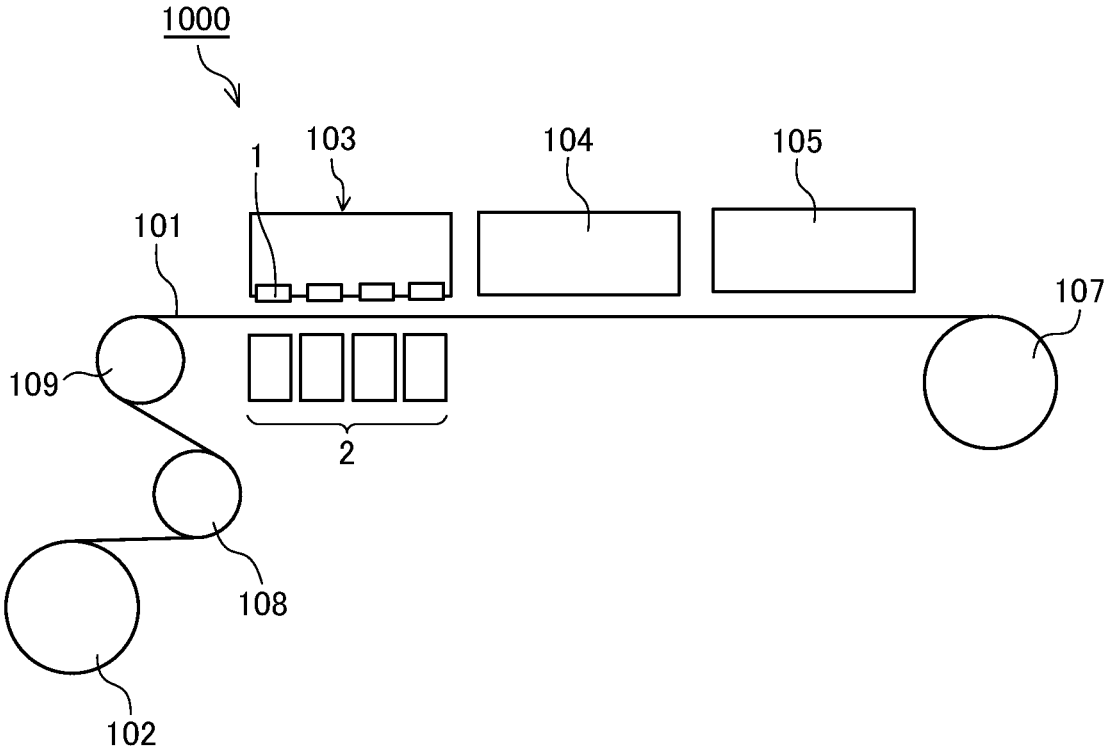
FIG. 10 is a schematic view of a dyeing apparatus according to an embodiment of the present disclosure.

A description is given below of a dyeing apparatus according to an embodiment of the present disclosure, with reference to FIG. 10. FIG. 10 is a schematic view of the dyeing apparatus.

In a dyeing apparatus 1000, the embroidery head 106 in the liquid discharge apparatus 100 is replaced with a take-up reel 107 (a winder) to wind the thread 101 after dyeing.

The dyeing apparatus 1000 supplies the thread 101 from the supply reel 102, discharges a liquid of a required color from the liquid application unit 103, dyes the thread 101 into a target color, and winds the dyed thread 101 with the take-up reel 107.

In the present disclosure. "liquid" discharged from a liquid discharge head is not particularly limited as long as the liquid has a viscosity and surface tension of degrees dischargeable from the liquid discharge head. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as deoxyribonucleic acid (DNA), amino acid, protein, or calcium, or an edible material, such as a natural colorant.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A liquid discharge apparatus comprising:

a head including a nozzle plate having a plurality of nozzles lined in a row and configured to discharge a liquid;

a conveyor defining a conveyance passage of a liquid application target to which the head applies the liquid, the conveyor configured to convey the liquid application target;

a liquid receptacle configured to receive the liquid discharged from the head, the liquid receptacle having an opening through which the liquid discharged from the head passes, the opening having:

a longitudinal direction along a movement direction of the liquid application target; and a width greater than a width of the liquid application target in a direction orthogonal to the movement direction; and a head conveyor configured to move the head, at least, between a discharge position opposite the conveyance passage, the discharge position at which the head discharges the liquid, and a dummy discharge position away from the conveyance passage in a direction orthogonal to a nozzle row direction in which the plurality of nozzles is lined in the row, wherein the opening of the liquid receptacle has a width greater than a distance from the discharge position to the dummy discharge position in the direction orthogonal to the nozzle row direction, and wherein the discharge position is shifted to one side from a center in a short-side direction of the opening, and the dummy discharge position is shifted to the other side from the center in the short-side direction of the opening.

2. The liquid discharge apparatus according to claim 1, wherein the liquid application target is a linear object.

3. The liquid discharge apparatus according to claim 1, wherein the liquid receptacle is at a distance from the conveyance passage of the liquid application target.

4. The liquid discharge apparatus according to claim 1, wherein the conveyance passage of the liquid application target is between the head and the opening of the liquid receptacle in a height direction of the liquid discharge apparatus, and wherein a distance from the conveyance passage to the liquid receptacle is longer than a distance between the head and the conveyance passage in the height direction.

5. The liquid discharge apparatus according to claim 1, further comprising a maintenance device configured to maintain the head, wherein the liquid receptacle is detachably attached to the maintenance device.

6. The liquid discharge apparatus according to claim 1, wherein the movement direction of the liquid application target matches the nozzle row direction, and wherein the head is one of a plurality of heads arranged along the movement direction of the liquid application target.

7. The liquid discharge apparatus according to claim 6, wherein the liquid receptacle is one of a plurality of liquid receptacles respectively for the plurality of heads.

8. A liquid discharge apparatus comprising:

a head including a nozzle plate having a plurality of nozzles lined in a row and configured to discharge a liquid;

a conveyor defining a conveyance passage of a liquid application target to which the head applies the liquid, the conveyor configured to convey the liquid application target;

a liquid receptacle configured to receive the liquid discharged from the head, the liquid receptacle having an opening through which the liquid discharged from the head passes, the opening having a width in a direction orthogonal to a nozzle row direction greater than a width of the liquid application target in a direction orthogonal to a movement direction of the liquid application target; and a head conveyor configured to move the head, at least, between a discharge position opposite the conveyance passage, the discharge position at which the head discharges the liquid, and a dummy discharge position away from the conveyance passage in a direction orthogonal to the nozzle row direction in which the plurality of nozzles is lined in the row, wherein the opening of the liquid receptacle has a width greater than a distance from the discharge position to the dummy discharge position in the direction orthogonal to the nozzle row direction, and wherein the discharge position is shifted to one side from a center in a short-side direction of the opening, and the dummy discharge position is shifted to the other side from the center in the short-side direction of the opening.

9. A liquid discharge device comprising:

a head including a nozzle plate having a plurality of nozzles lined in a row and configured to discharge a liquid; and a liquid receptacle configured to receive the liquid discharged from the head, the liquid receptacle having an opening through which the liquid discharged from the head passes, the opening having:

a longitudinal direction along a movement direction of a liquid application target; and a width greater than a width of the liquid application target in a direction orthogonal to the movement direction; and a head conveyor configured to move the head, at least, between a discharge position opposite a conveyance passage, the discharge position at which the head discharges the liquid, and a dummy discharge position away from the conveyance passage in a direction orthogonal to a nozzle row direction in which the plurality of nozzles is lined in the row, wherein the opening of the liquid receptacle has a width greater than a distance from the discharge position to the dummy discharge position in the direction orthogonal to the nozzle row direction, and wherein the discharge position is shifted to one side from a center in a short-side direction of the opening, and the dummy discharge position is shifted to the other side from the center in the short-side direction of the opening.

10. A dyeing apparatus comprising the liquid discharge device according to claim 9.

* * * * *